US007066503B2

(12) United States Patent
Smith et al.

(10) Patent No.: US 7,066,503 B2
(45) Date of Patent: Jun. 27, 2006

(54) SPRINGLESS OVEN DOOR LATCH ASSEMBLY

(75) Inventors: Donald E. Smith, Smithville, TN (US); Matthew L. Michel, Dowelltown, TN (US)

(73) Assignee: France/Scott Fetzer Company, Fairview, TN (US)

( * ) Notice: Subject to any disclaimer, the term of this patent is extended or adjusted under 35 U.S.C. 154(b) by 234 days.

(21) Appl. No.: 10/884,162

(22) Filed: Jul. 2, 2004

(65) Prior Publication Data

US 2006/0001273 A1 Jan. 5, 2006

(51) Int. Cl.
*E05C 3/06* (2006.01)

(52) U.S. Cl. ..... 292/201; 292/DIG. 69; 126/197

(58) Field of Classification Search ..... 292/201, 292/DIG. 69, 109; 126/197
See application file for complete search history.

(56) References Cited

U.S. PATENT DOCUMENTS

| | | | | |
|---|---|---|---|---|
| 3,750,643 | A * | 8/1973 | Fowler et al. | 126/197 |
| 4,374,320 | A | 2/1983 | Barnett | |
| 5,029,910 | A * | 7/1991 | Genbauffe et al. | 292/110 |
| 5,577,583 | A * | 11/1996 | O'Donnell | 192/79 |
| 6,302,098 | B1 | 10/2001 | Smith | |
| 6,315,336 | B1 | 11/2001 | Swartzell | |
| 6,698,418 | B1 | 3/2004 | Ramsey et al. | |

* cited by examiner

*Primary Examiner*—Gary Estremsky
(74) *Attorney, Agent, or Firm*—Wood, Herron & Evans, LLP

(57) ABSTRACT

A springless motorized door latch assembly for locking an oven door in a locked and sealed position for purposes of cleaning the oven. A motor and cam cause a latch member to move between three different positions. In one position the latch member prevents the oven door from opening. From this position, the latch member is pulled inwardly so the oven door is in a locked and sealed position. In its locked and sealed position the door may not be opened.

18 Claims, 6 Drawing Sheets

SPRINGLESS OVEN DOOR LATCH ASSEMBLY

FIELD OF THE INVENTION

This application relates to a motorized oven door latch assembly for locking an oven door in a closed position when the oven is in a self-cleaning mode.

BACKGROUND OF THE INVENTION

Self-cleaning ovens which are incorporated into self-standing ranges are well known. Such ovens conventionally have an oven door which is hingedly secured to a range body. The oven door may be opened to gain access to an oven cavity. The oven door may also be closed to close the opening for cooking objects placed in the cavity or cleaning the cavity. One or more heating elements reside in the oven cavity for cooking purposes.

Motorized latches which are used to lock oven doors in a closed position so that the oven cavity may be self cleaned are well known.

Assignee's U.S. Pat. Nos. 6,302,098 and 6,698,418 each disclose a motorized oven door latch assembly for locking an oven door in a locked and sealed position for purposes of cleaning the oven. Such oven door latches are activated by a rotary motor located remotely from the latch member above the oven cavity. Activation of the motor causes a rod to translate which causes a latch member secured to the front of the rod to engage the oven door so that the oven door may not be opened. After the cleaning has occurred, the motor is reactivated, causing the latch member at the front of the rod to disengage the oven door so that the oven door may be opened.

Each of these motorized oven door latch assemblies utilizes a spring mechanism to bias the latch member into engagement with the oven door. The spring is typically secured at one end to a mounting plate secured to the range and is secured at the other end to the movable latch member. With repeated use, the spring may wear down and may eventually fail to function properly if subject to enough use.

Motorized range lock assemblies such as the one disclosed in U.S. Pat. No. 6,315,336 have been manufactured and sold without such a spring. One disadvantage with motorized oven door latch assemblies having no spring is that the latch member moves between two positions rather than three. In other words, existing range lock assemblies without springs do not provide what is known in the industry as a "pull in" feature. The pull in feature enables the oven door to move to a locked and sealed position when the latch member is in its third position. When the latch member is in this third pulled in position, the motorized range lock assembly causes the oven door to exert pressure on a gasket sandwiched between the front wall of the range and the oven door.

Therefore, a need exists for a motorized oven door latch assembly which provides the pull in feature without the use of a spring.

SUMMARY OF THE INVENTION

The invention which accomplishes these objectives comprises a motorized door latch assembly for locking an oven door in a closed and sealed position so as to close an oven cavity for purposes of cleaning the oven cavity. The oven door is hingedly mounted on a range body and moveable between an open position, a closed position and a closed and sealed position.

The door latch assembly comprises a mounting plate supported by the range body above the oven cavity and extending generally horizontally. The mounting plate has a guide therethrough proximate the front of the mounting plate. The mounting plate also has a pair of mounting tabs extending upwardly from the body of the mounting plate. The mounting tabs have holes therein to receive fasteners for purposes of mounting the motor above the mounting plate in a location in which the motor does not overheat.

Fixedly secured to the mounting tabs of the mounting plate is a driver such as a motor assembly including a motor and a drive spline. The motor may be fixedly or removably secured to the mounting tabs of the mounting plate or any other portion of the mounting plate at any desired location. The motor rotates a drive spline which extends downwardly from the motor and is engaged with a spline hole formed in a cam, operatively associated with the motor. Thus rotation of the drive spline by the motor assembly causes the cam to rotate.

The cam is sandwiched between the latch member and the motor. The underside of the cam has a contact portion which contacts flanges of the latch member to move the latch member to its desired position upon rotation of the cam.

A latch plate or latch member, having a hook at one end for engaging the oven door, is moved between three positions by rotation of the cam. The latch member is movable between a first position in which the oven door may be opened; a second position in which the oven door may not be opened and a third position in which the oven door is in a locked and sealed position.

The latch member has a pair of spaced parallel upwardly extending flanges at the rear end of the latch member. Rotation of the cam causes a portion of the cam to engage or contact the flanges of the latch member to move the latch member between the three positions.

One of the latch member and mounting plate has a pin and the other of the latch member and mounting plate has a guide in which the pin moves. The size and configuration of the guide and location of the pin restrict the movement of the latch member so as to move the latch member between the three desired positions.

One or more switches may be secured to the mounting plate and operated by rotation of the cam. Contact between the cam and the switches signals a controller which controls operation of the motor.

In operation, rotation of the cam by activation of the motor causes the latch member to move between the three positions. In the first position, the latch member is located such that the oven door may be opened and closed. Upon further rotation of the cam, the latch member moves to a second position in which the hook of the latch member engages the oven door to prevent the oven door from being opened and closed. In the third position, the latch member is pulled inwardly by the cam, pulling the oven door into a locked and sealed position.

DETAILED DESCRIPTION OF THE DRAWINGS

Figure 1:
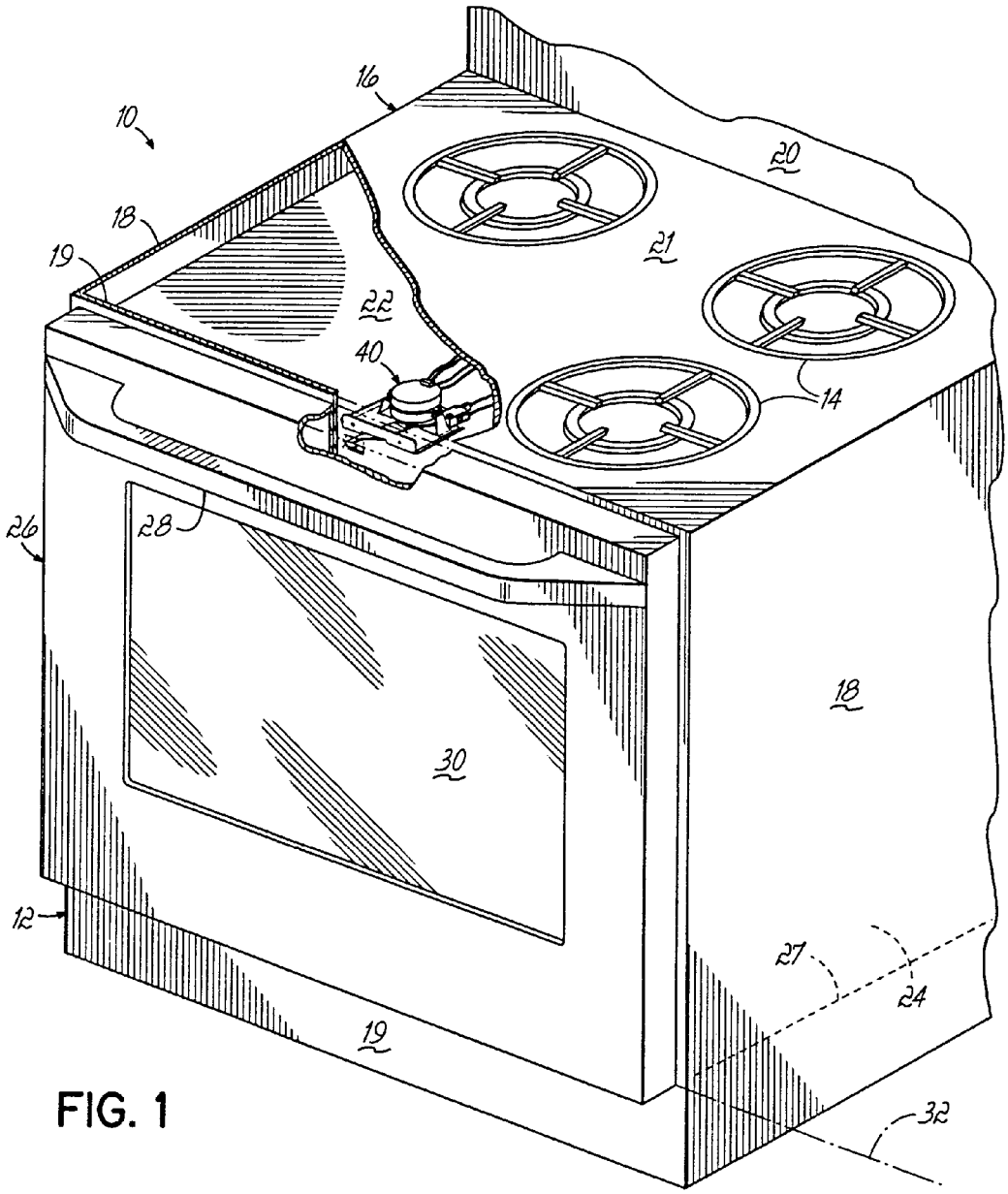
FIG. 1 is a perspective view of a self-standing range, with a portion cut away, having the motorized oven door latch assembly of the present invention.

Referring to the drawings, and particularly to FIG. 1, there is illustrated a self-standing range 10 including a pyrolytic self-cleaning oven 12 on top of which are a plurality of burners 14 as is conventional. The range 10 comprises a range body 16 having a pair of side walls 18, a front wall 19, a back wall 20 (see FIG. 1) and a top 21. Spaced a fixed distance below the top 21 of the range body 16 is an oven top wall 22. An oven cavity 24 inside which resides one or more heating elements (not shown) is defined by the oven top wall 22, side walls 18 of the range body, a cavity back wall (not shown) and a bottom 27. An oven door 26 having a handle 28 and a window 30 is hingedly mounted to the front wall 19 of the range body so that a user pulling on the handle 28 will cause the oven door 26 to hingedly open about an horizontal axis 32 in order to move the door 26 between a closed position as shown in FIG. 1 and an open position.

As best illustrated in FIGS. 4–8, the oven door 26 has a thickness T defined between a back wall 34 and a front wall 36 between which is insulation 38. The back wall 34 has an opening 39 formed therein.

Illustrated within range 10 above top wall 22 and below top 21 of the range body 16, is a motorized door latch assembly 40 mounted to the range body 16 and/or the range walls 21 and 22, and positioned to latch door 26 in a closed and sealed position by the action of the front hook 90 of a latch member 42. Further detail on the structure of motorized door latch assembly 40 and the interaction of latch member 42 with oven door 26 is provided below.

Figure 2:
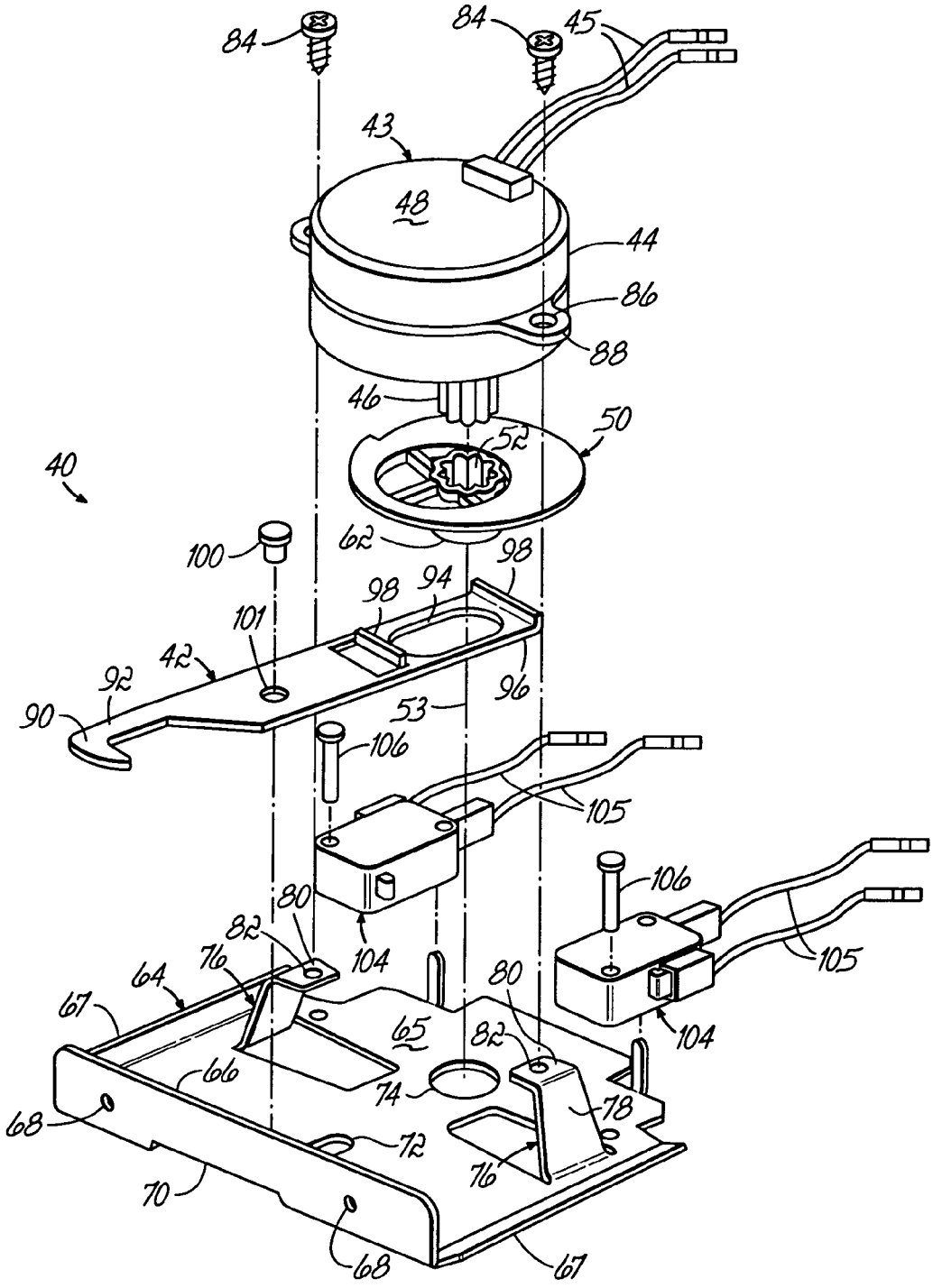
FIG. 2 is an disassembled perspective view of the motorized oven door latch assembly shown in FIG. 1.

As best illustrated in FIG. 2, the door latch assembly 40 functions to lock the oven door 26 in a closed and sealed position so that the oven door 26 may not be opened e.g. when the oven is in a self-cleaning mode. The motorized door latch assembly 40 comprises multiple components which work together to move a latch member 42, best illustrated in FIG. 2, between three different positions so that the oven door 26 may be opened when the latch member 42 is in a first position and the oven door 26 may not be opened when the latch member 42 is in either its second or third position.

The door latch assembly 40 comprises a motor assembly 43 including a motor 44 activated by power lines 45. One type of motor which has proven satisfactory is manufactured by assignee and operates at 120 volts AC; 60 Hz having a speed of 2 rpm. The motor assembly 43 further includes a drive spline 46 extending downwardly from a motor housing 48.

A cam 50 is operatively coupled to the motor assembly 43. The cam 50 has a spline hole 52 configured and adapted to receive and retain the drive spline 46 of the motor 44 such that rotation of the drive spline 46 of the motor 44 causes the cam 50 to rotate about a vertical axis 53. See FIG. 2.

Figure 9:
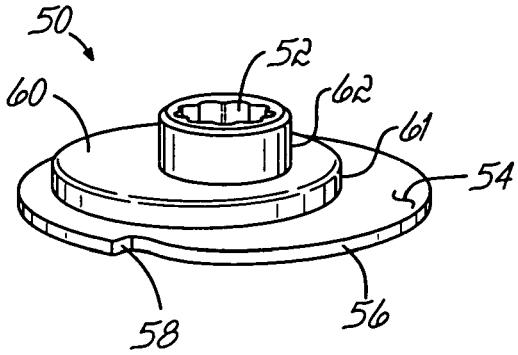
FIG. 9 is a bottom perspective view of the cam of the the motorized oven door latch assembly shown in FIG. 1.

As seen in FIG. 9, the cam 50 has an upper portion 54 having a peripheral edge 56. An indent 58 is formed in the upper portion 54 and extends inwardly from the peripheral edge 56 of the upper portion 54 to activate the switches in a manner described below. Below the upper portion 54 of the cam 50 is a contact portion 60 having a peripheral edge 61. The peripheral edge 61 contacts the flanges 98 of the latch member 42 in a manner described below. See FIG. 2. Below the contact portion 60 of the cam 50 is a spline portion 62. The spline hole 52 extends through the entire cam 50 including the spline portion 62, the contact portion 60 and the upper portion 54.

Figure 3:
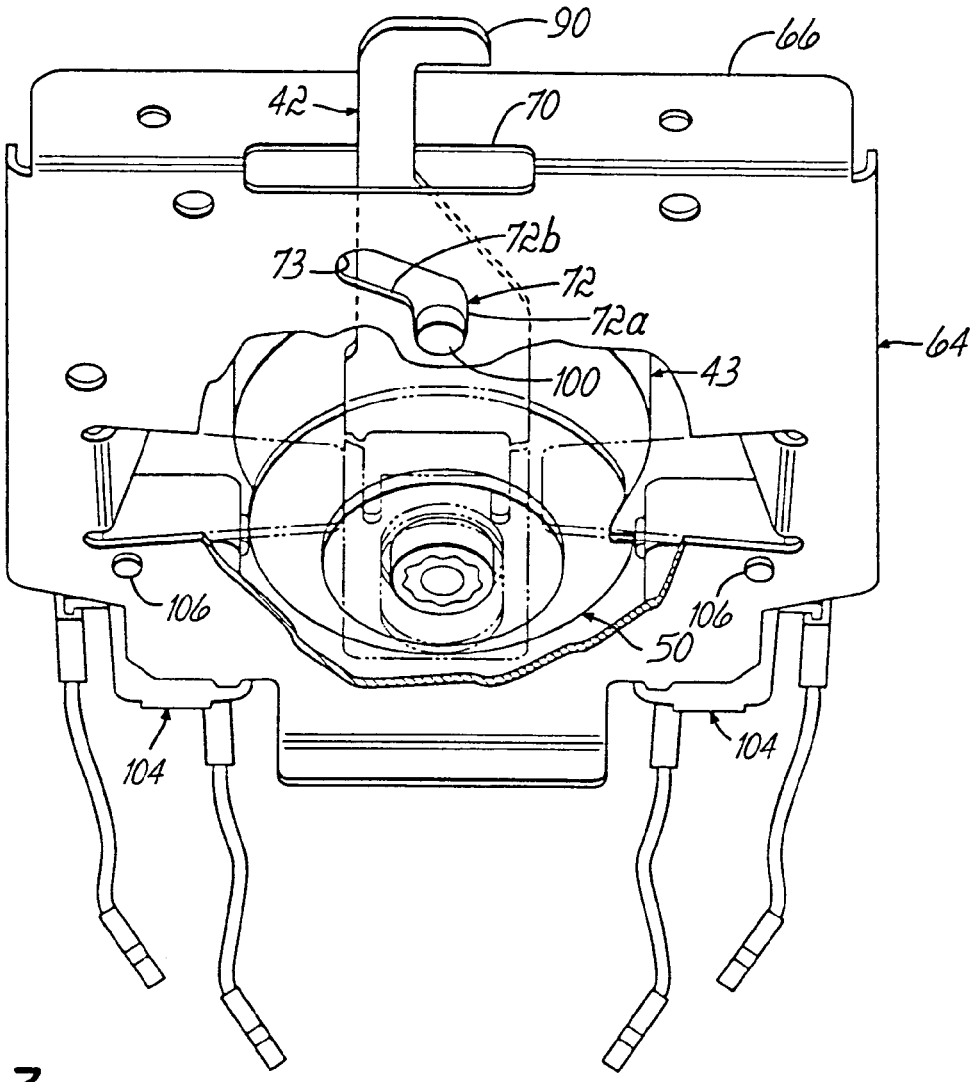
FIG. 3 is a bottom perspective view of the motorized oven door latch assembly of the present invention.

Referring again to FIG. 2, a generally rectangular mounting plate 64 is secured to range 10 in any desired manner. The mounting plate 64 has a generally planar body 65, a front lip 66 extending upwardly from the front of the body 65 along with two side lips 67 extending upwardly from the sides of the body 65. The front lip 66 preferably is secured the front wall 19 of the range 10 with fasteners (not shown) extending through holes 68 in the front lip 66 of the mounting plate 64. Preferably, the mounting plate 64 is located below the top 21 of the range and above the top wall 22 of the oven cavity. As best seen in FIG. 3, the front lip 66 of the mounting plate 64 has a generally rectangular opening 70 through which the latch member 42 passes. Although the drawings illustrate one configuration of mounting plate 64 located in a particular orientation, the mounting plate 64 may be secured to the range in other locations or be other configurations without departing from the spirit of the invention.

As best illustrated in FIG. 3, an opening or guide 72 is located through the body 65 of the mounting plate 64. The guide 72 is an opening of a particular configuration illustrated in detail in FIG. 3 comprising a generally linear shaped rear portion 72*a* and a generally linear shaped front portion 72*b* having a stopping surface 73. The front and rear portions 72*b*, 72*a* of the guide 72 form an obtuse angle therebetween giving the guide 72 a generally L-shaped configuration. The size and configuration of the guide 72 limits the movement of the latch member 42 in a manner described in more detail below.

As illustrated in FIG. 2, the body 65 of the mounting plate 64 also has a circular hole 74 therethrough which is sized and adapted to receive the spline portion 62 of the cam 50.

The mounting plate 64 also has a pair of mounting tabs 76 integrally formed from the body 65 of the mounting plate 64 and extending upwardly from the body 65 of the mounting plate 64. Each of the mounting tabs 76 has a generally vertical first portion 78 and a generally horizontal second portion 80 having a threaded hole 82 therethrough adapted to receive a fastener 84 passing through holes 86 in flanges 88 in the motor housing 48. As seen in FIG. 2, the mounting tabs 76 enable the motor 44 to be mounted above the body 65 of the mounting plate 64 in a location in which the cam 50 may be sandwiched between the latch member 42 and the motor housing 48. Furthermore, the mounting tabs 76 enable the motor 44 to be mounted above the oven top wall so the motor 44 does not overheat.

Another component of the motorized door latch assembly 40 is the latch member 42 best illustrated in FIG. 2. The latch member 42 has a hook 90 located at a front end 92 and an oval shaped opening 94 formed through the latch member 42 proximate a rear or back end 96 of the latch member 42. Between the front and back ends 92, 96 of the latch member 42 the oval shaped opening 94 of the latch member 42 is adapted to receive the spline portion 62 of the cam 50.

As best illustrated in FIG. 2, a pair of spaced, parallel upwardly extending flanges 98 at the rear end 96 of the latch member 42 are located to contact the peripheral edge 61 of the contact portion 60 of the cam 50 as the cam 50 rotates.

Referring to FIG. 2, a pin 100 is secured to the latch member 42 in hole 101 of the latch member 42 and extends downwardly therefrom in a fixed location. The pin 100 remains inside the guide 72 formed in the body 65 of the mounting plate 64 as the latch member 42 moves between positions. Alternatively, the pin 100 may be secured to the mounting plate 64 and the guide formed in the latch member 42 to restrict movement of the latch member 42 as the latch member 42 moves between positions.

Figure 4:
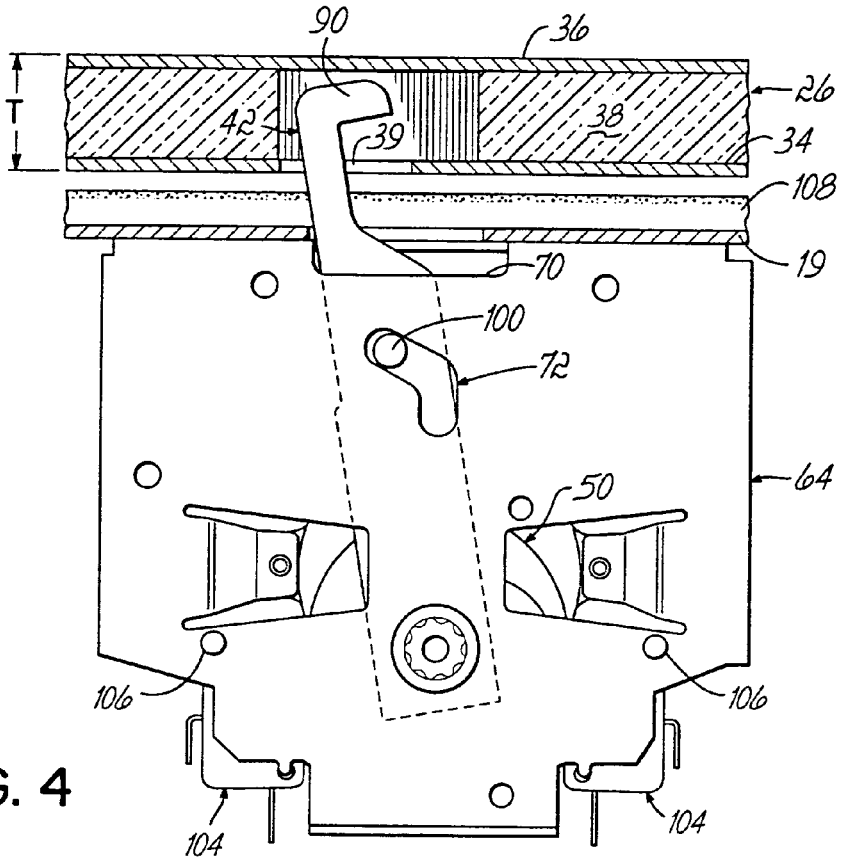
FIG. 4 is a bottom view of the motorized oven door latch assembly illustrating the latch member in a first position in which the oven door may be opened.
Figure 5:
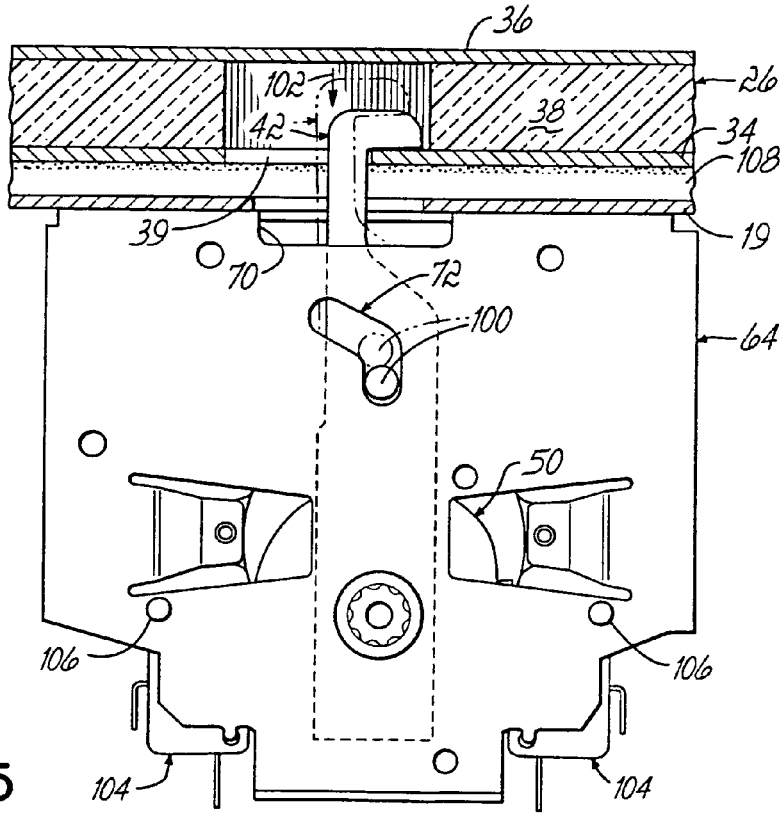
FIG. 5 is a bottom view of the motorized oven door latch assembly illustrating the latch member in second and third positions in which the oven door may not be opened.
Figure 6:
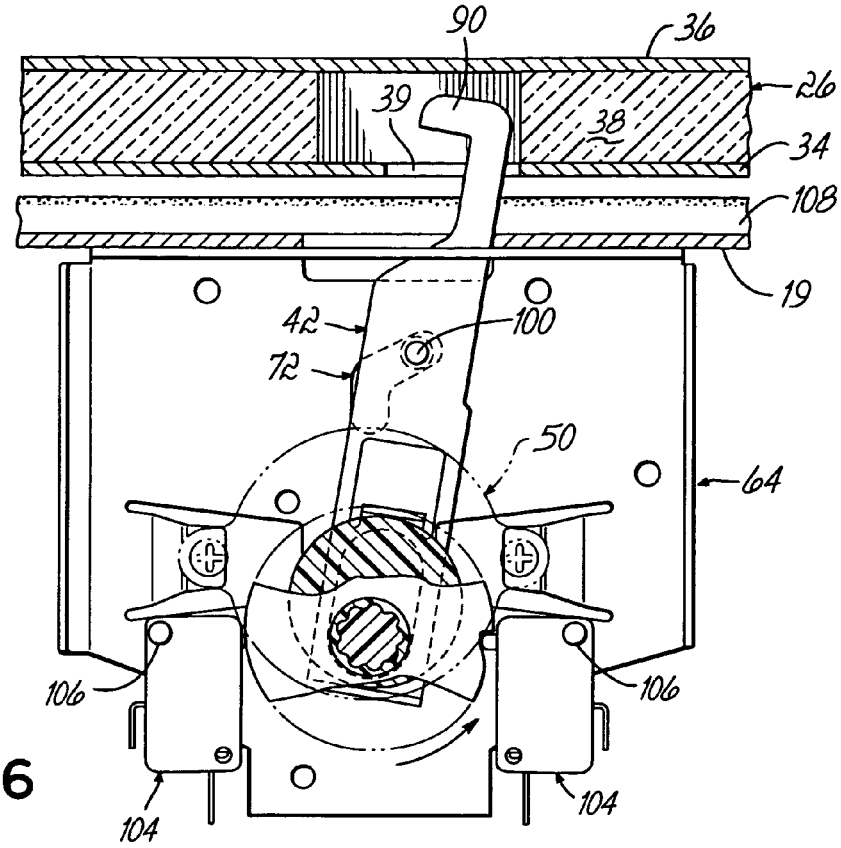
FIG. 6 is a top view of the motorized oven door latch assembly illustrating the latch member in a first position in which the oven door may be opened.
Figure 7:
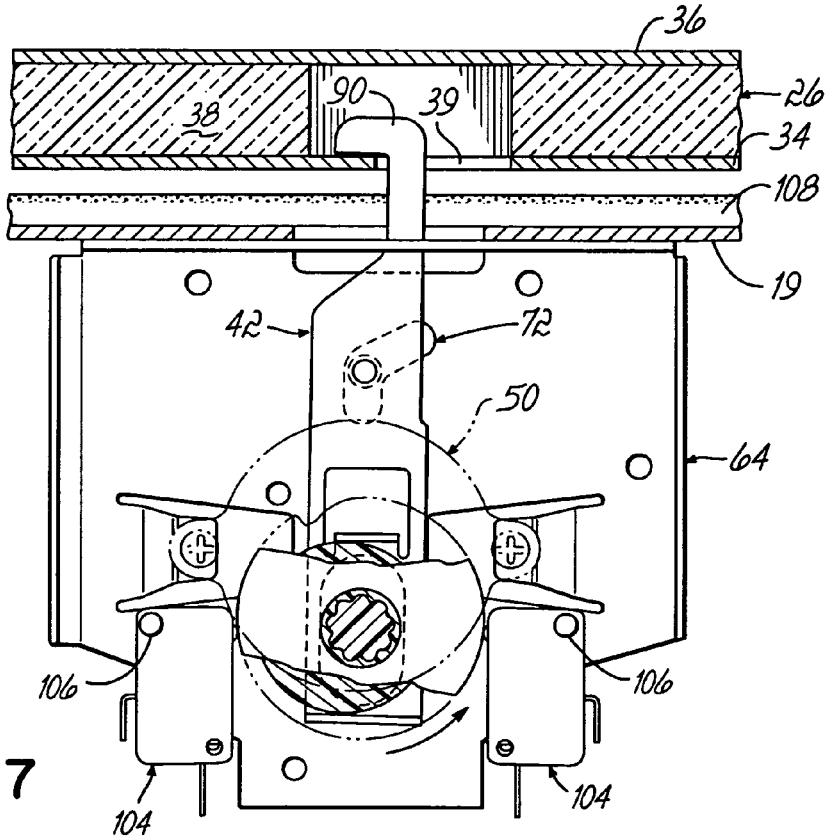
FIG. 7 is a top view of the motorized oven door latch assembly illustrating the latch member in a second position in which the oven door may not be opened.
Figure 8:
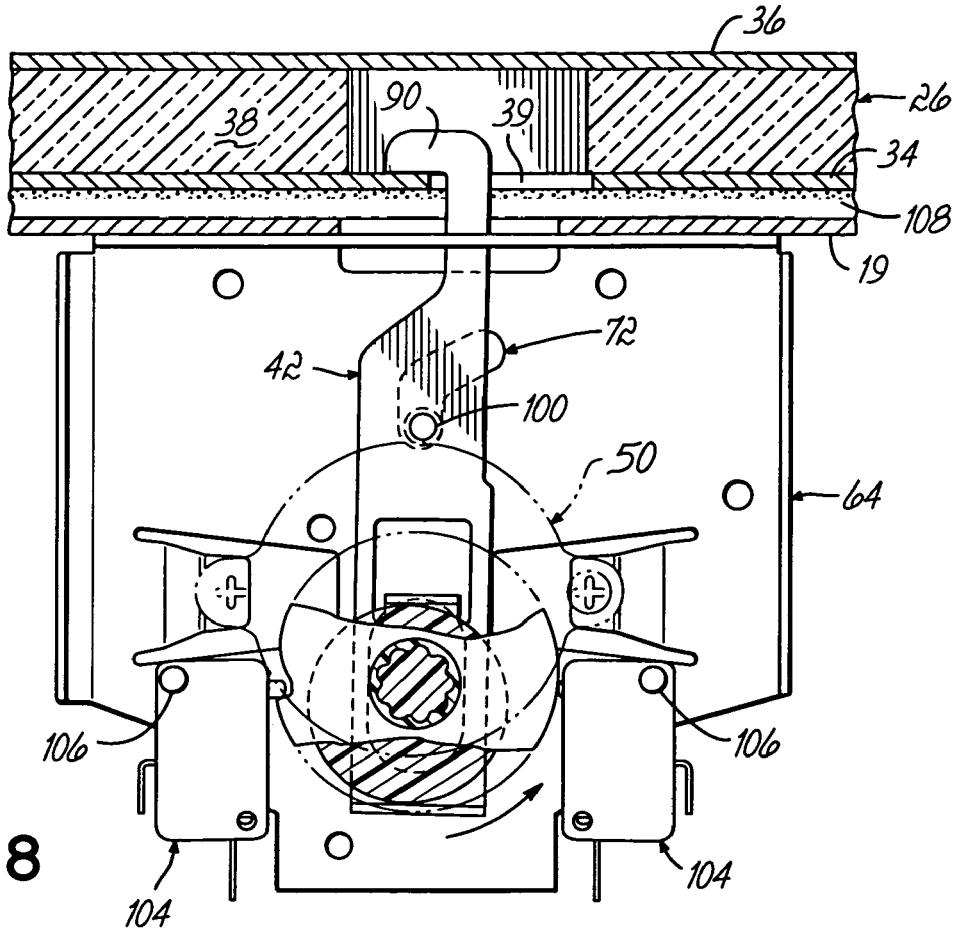
FIG. 8 is a top view of the motorized oven door latch assembly illustrating the latch member in a third position in which the oven door is in a locked and sealed position.

As best illustrated in FIGS. 4–8, the latch member 42 is movable between three positions: a first position illustrated in FIGS. 4 and 6, a second position illustrated in FIG. 7 and in dashed lines in FIG. 5 and a third position illustrated in FIGS. 5 and 8 (in which the door is locked and sealed). In the first position, the hook 90 of the latch member 42 is aligned with and may pass through an opening 39 in the back wall 34 of the oven door 26 (see FIGS. 4 and 6). With the latch member 42 in this first position, the oven door 26 may be freely opened and closed, the hook 90 of the latch member 42 passing through the opening 39 in the oven door 26. As the cam 50 rotates due to activation of the motor 44, the latch member 42 moves to its second position, which is shown in dashed lines in FIG. 5 and in FIG. 8. When the latch member 42 is in this second position, the oven door 26 may not be opened because the hook 90 of the latch member 42 catches the back wall 34 of the oven door 26. Upon further rotation of the cam 50, the latch member 42 is pulled rearwardly in the direction of arrow 102 to its third position (illustrated in solid lines in FIG. 5 and in FIG. 8) in which the oven door 26 is locked and sealed. In this position, the oven door 26 is correctly sealed and seated so as to provide a tight seal for the oven cleaning process.

As best illustrated in FIG. 2, the motorized door latch assembly 40 further comprises a pair of switches 104 secured to the mounting plate 64 with fasteners 106. One type of switch which has proven satisfactory is manufactured by Toneluck and sold as part number L62BJ. Such a switch is SPST Normally Closed, rated at 5 Amp at 120/240 volts AC. However, any other switch may be used in accordance with this invention. The indent 58 on the periphery 56 of the upper portion 54 of the cam 50 alternatively operates the switches 104 as it passes the switches 104. As shown in FIG. 3, wires 105 connected to the switches 104 communicate with a controller (not shown) to let the controller (not shown) know the position of the cam 50 and also the position of the latch member 42.

In operation, upon activation of the motor 44, the cam 50 rotates, causing the latch member 42 to move from its first position shown in FIGS. 4 and 6 to its second position in which the oven door 26 is prevented from opening (See FIGS. 5 AND 7). Upon further rotation of the cam 50, the latch member 42 is pulled rearwardly from its second position to its third position in the direction of arrow 102. When the latch member 42 is in its third position the oven door 26 is in a locked and sealed position with the back wall 34 of the oven door 26 exerting pressure against a gasket 108 located between the oven door 26 and the front wall 19 of the range body.

While we have described one preferred embodiment of the present invention, persons skilled in the art will appreciate changes and modifications which may be made to the present invention without departing from the scope of the invention. Therefore, we do not intend to be limited except by the scope of the following claims.

We claim:

1. A motorized door latch assembly for locking an oven door in a closed position closing an oven cavity, said oven door being mounted on a range body and being movable between an open and said closed position, said door latch assembly comprising:

a mounting plate supported by said range body above said oven cavity;

a motor;

a cam rotatably driven by said motor;

a latch member having a hook at a first end thereof, said hook being adapted to engage said oven door, said latch member being contacted by said cam and movable between a first position in which said oven door may be opened, a second position in which said oven door may not be opened, and a third position in which said hook is moved relative to said second position to pull in said oven door toward said oven cavity.

2. The motorized door latch of claim 1 wherein said latch member has a pair of spaced upwardly extending flanges wherein rotation of said cam causes said cam to engage said flanges of said latch member and move said latch member.

3. The motorized door latch of claim 1 wherein said motor is secured to said mounting plate in a fixed position above said mounting plate.

4. The motorized door latch of claim 1 wherein said cam is sandwiched between said mounting plate and said motor.

5. The motorized door latch of claim 1 wherein said mounting plate has a guide in which rides a pin secured to said latch member.

6. The motorized door latch of claim 1 further comprising switches secured to said mounting plate and operated by the cam, each of said switches moving between open and closed positions as the cam rotates.

7. The motorized door latch of claim 1 wherein one of said mounting plate and said latch member has a pin and the other of said mounting plate and said latch member has a guide in which said pin moves to restrict movement of said latch member.

8. The motorized door latch assembly of claim 1 wherein said hook extends through a mounting surface of said range body.

9. The motorized door latch assembly of claim 1 wherein said cam has a contact portion for engaging said flanges of said latch member.

10. A motorized door latch assembly for locking an oven door in a closed position, said oven door being mounted on a range body and being movable between an open and closed position, said door latch assembly comprising:

a mounting plate supportable by said range body above an oven cavity, a motor secured to said mounting plate above said mounting plate, a cam rotatably driven by the motor, a latch member sandwiched between said cam and said mounting plate, said latch member having a hook at an outer end and being movable by rotation of said cam between a first position in which said oven door may be opened and a second position in which said hook of said latch member engages said oven door preventing said oven door from opening.

11. The motorized door latch assembly of claim 10 wherein said latch member has a pair of spaced, parallel flanges, wherein upon rotation of said cam by said motor, a portion of said cam contacts said flanges of said latch member, moving said latch member between said first and second positions.

12. The motorized door latch of claim 10 wherein one of said mounting plate and said latch member has a pin and the other of said mounting plate and said latch member has a guide in which said pin moves to restrict movement of said latch member.

13. The motorized door latch assembly of claim 10 wherein said latch member may be moved from said second position to a third position upon further rotation of said cam.

14. The motorized door latch assembly of claim 10 wherein said mounting plate has upwardly extending mounting tabs to which said motor is mounted.

15. The motorized door latch of claim 10 further comprising a pair of switches fixed to said mounting plate and operated by the cam, each switch moving between open and closed positions as the cam rotates.

16. A motorized door latch assembly for locking an oven door in a closed position so as to close an oven cavity for purposes of cleaning said oven cavity, said oven door being mounted on a range body, said door latch assembly comprising:

a mounting plate supportable by said range body above said oven cavity;

a motor mounted to said mounting plate;

a cam rotatably driven by said motor;

a latch member located between said cam and said mounting plate, said latch member having a hook at one end for engaging said oven door, wherein upon rotation of said cam a portion of said cam contacts said latch member, moving said latch member between a second position in which said hook of said latch member engages said oven door preventing said oven door from opening and a first position in which said oven door may be opened; and a pair of switches mounted to said mounting plate and operated by rotation of said cam, each of the switches being operatively coupled to a controller.

17. The motorized door latch assembly of claim 16 wherein said latch member may be moved from said second position to a third position upon further rotation of said cam.

18. The motorized door latch of claim 16 wherein said latch member has a pair of spaced upwardly extending flanges wherein rotation of said cam causes said cam to engage said flanges of said latch member and move said latch member.

* * * * *